US012471641B2

(12) United States Patent
Lacambra et al.

(10) Patent No.: US 12,471,641 B2
(45) **Date of Patent: *Nov. 18, 2025**

(54) WIRE-FREE PUSH-UP BRASSIERE WITH HINGE FOR IMPROVED SUPPORT AND FLEXIBILITY

(71) Applicant: Torrid LLC, City of Industry, CA (US)

(72) Inventors: Vince Lacambra, Eastvale, CA (US); Elizabeth Munoz-Guzman, Arcadia, CA (US)

(73) Assignee: Torrid LLC, City of Industry (CA)

( * ) Notice: Subject to any disclaimer, the term of this patent is extended or adjusted under 35 U.S.C. 154(b) by 0 days.

This patent is subject to a terminal disclaimer.

(21) Appl. No.: 18/907,143

(22) Filed: Oct. 4, 2024

(65) Prior Publication Data

US 2025/0024897 A1 Jan. 23, 2025

Related U.S. Application Data

(63) Continuation of application No. 17/741,309, filed on May 10, 2022, now Pat. No. 12,121,079.

(60) Provisional application No. 63/186,647, filed on May 10, 2021.

(51) Int. Cl.
*A41C 3/12* (2006.01)

(52) U.S. Cl.
CPC ..... *A41C 3/124* (2013.01)

(58) Field of Classification Search
CPC ..... A41C 3/124
See application file for complete search history.

(56) References Cited

U.S. PATENT DOCUMENTS

| | | | | |
|---|---|---|---|---|
| 2,634,419 | A | 4/1953 | Pioli | |
| 8,747,184 | B2 * | 6/2014 | Liu | A41C 3/0007 450/47 |
| 9,480,287 | B2 * | 11/2016 | Black | A41C 3/0057 |
| 10,568,365 | B2 | 2/2020 | Hirakubo | |
| 11,766,076 | B2 * | 9/2023 | Cahan | A41C 5/005 450/53 |
| 12,121,079 | B2 * | 10/2024 | Lacambra | A41C 3/0007 |
| 2007/0026767 | A1 * | 2/2007 | Scheininger | A41C 3/0028 450/39 |

(Continued)

FOREIGN PATENT DOCUMENTS

CA 2750309 C 1/2016

*Primary Examiner* — Gloria M Hale
(74) *Attorney, Agent, or Firm* — Sheppard Mullin Richter & Hampton LLP

(57) ABSTRACT

Embodiments of the disclosed technology relate to wire-free push-up brassieres having the versatility to provide enhanced lift, support, and comfort across a range of breast sizes. A wire-free push-up brassiere disclosed herein includes a hinge that extends along a bottom edge of the padded portions of cups of the brassiere. The hinge may be a stabilizing channel formed between the bottom edge of the padded cup portions and a top edge of the cradle. The hinge may be formed of a stabilizing material that provides the hinge with both rigidity and flexibility. In particular, the stabilizing material may impart a rigidity to the hinge that reinforces the breast support provided by the cups, thereby enhancing the push-up characteristics of the brassiere. At the same time, the stabilizing material may have enough flexibility to allow the hinge to accommodate a range of breast sizes.

10 Claims, 9 Drawing Sheets

(56) References Cited

U.S. PATENT DOCUMENTS

| | | | | |
|---|---|---|---|---|
| 2012/0149277 | A1 | 6/2012 | Moses-Jones et al. | |
| 2012/0184181 | A1* | 7/2012 | Liu | A41C 3/128 428/80 |
| 2015/0087203 | A1* | 3/2015 | Turlan-Van Der Hoeven | A41C 3/10 450/93 |
| 2016/0165964 | A1* | 6/2016 | West | A41C 3/0007 450/53 |
| 2018/0310640 | A1 | 11/2018 | Melendez et al. | |

* cited by examiner

WIRE-FREE PUSH-UP BRASSIERE WITH HINGE FOR IMPROVED SUPPORT AND FLEXIBILITY

CROSS-REFERENCE TO RELATED APPLICATION(S)

The present application is a continuation of U.S. Non-provisional application Ser. No. 17/741,309, filed May 10, 2022, now U.S. Pat. No. 12,121,079, and entitled "Wire-Free Push-Up Brassiere With Hinge For Improved Support and Flexibility," which claims the benefit of U.S. Provisional Patent Application Ser. No. 63/186,647, filed May 10, 2021, and entitled "Wirefree Lightly Lined and Push Up Brassieres," which is hereby incorporated by reference herein.

TECHNICAL FIELD

This disclosure pertains to articles of clothing, and more particularly, to wire-free push-up brassieres having a hinge that provides improved breast support and greater flexibility in accommodating different breast sizes.

BACKGROUND

A brassiere (referred to in common parlance as "bra") is an article of clothing many women wear to support their breasts in a manner that is both comfortable and attractive. The need to wear a brassiere is particularly important for fuller-bodied women or women whose breast size is otherwise generally larger than average.

A wide range of brassiere designs have been offered to provide breast support while also attempting to pleasantly shape the breast and provide a desired aesthetic. Push-up brassieres—a particular category of brassieres—include an underwire, padded cups, or both. The underwire runs along the bottom of the cups to provide a lift to the bosom from below. The cups may be padded to provide enhanced comfort and also to fill out the bust and create an impression of a larger cup size. Wire-free brassieres do not include the underwire.

SUMMARY

Embodiments of the disclosed technology relate to wire-free push-up brassieres having the versatility to provide enhanced lift, support, and comfort across a range of breast sizes. A wire-free push-up brassiere according to example embodiments of the disclosed technology includes a hinge that extends along a bottom edge of the padded portions of cups of the brassiere. The hinge may be a stabilizing channel formed between the bottom edge of the padded cup portions and a top edge of the cradle. In some embodiments, a width of the hinge channel may be defined by a vertical distance between a flexible cord that extends along a bottom edge of padded cup portions and a wire casing provided at a top portion of the cradle. The hinge may be formed of a stabilizing material that provides the hinge with both rigidity and flexibility. In particular, the stabilizing material may impart a rigidity to the hinge that reinforces the breast support provided by the cups, thereby enhancing the push-up characteristics of the brassiere. At the same time, the stabilizing material may have enough flexibility to allow the hinge to accommodate a range of breast sizes. In particular, the hinge may be flexible enough to transition between a folded state for smaller breast sizes and an expanded state in which the hinge serves as a expansion portion of the cups to provide enhanced support for larger breast sizes.

In an example embodiment, a push-up brassiere is disclosed. The push-up brassiere includes a left cup comprising a left padded cup portion and a right cup comprising a right padded cup portion; a bridge that medially connects the left padded cup portion and the right padded cup portion; a cradle; and a hinge that extends between respective bottom edges of the left padded cup portion and the right padded cup portion and a top edge of the cradle.

In an example embodiment, the push-up brassiere includes a wire casing that extends along the top edge of the cradle.

In an example embodiment, the hinge is provided within an undercup channel that extends laterally across the brassiere between the respective bottom edges of the left padded cup portion and the right padded cup portion and a top edge of the wire casing.

In an example embodiment, the hinge extends along substantially the entire undercup channel.

In an example embodiment, the channel has a width defined by a vertical distance between the respective bottom edges of the left padded cup portion and the right padded cup portion and the top edge of the wire casing.

In an example embodiment, the hinge is configured to transition from a folded state to one or more expanded states based at least in part on a breast size of a wearer of the push-up brassiere.

In an example embodiment, the respective bottom edges of the left padded cup portion and the right padded cup portion define respective bottom edges of the left cup and the right cup when the hinge is in the folded state.

In an example embodiment, the push-up brassiere includes an outer fabric casing that encapsulates at least the left cup and the right cup.

In an example embodiment, the hinge is hidden from view by the outer fabric casing when the hinge is in the folded state.

In an example embodiment, the hinge remains in the folded state when the push-up brassiere is worn by a wearer having a breast size less than or equal to a first threshold breast size.

In an example embodiment, the one or more expanded states comprise one or more partially expanded states and a fully expanded state.

In an example embodiment, the hinge is in one of the one or more partially expanded states when the push-up brassiere is worn by a wearer having a breast size greater than the first threshold breast size and less than or equal to a second threshold breast size.

In an example embodiment, the hinge is in the fully expanded state when the push-up brassiere is worn by a wearer having a breast size greater than the second threshold breast size.

In an example embodiment, the hinge functions as a cup expansion portion of the first cup and the second cup when the hinge is in the fully expanded state.

In an example embodiment, the hinge comprises a stabilizer material that has a greater rigidity than an outer fabric casing of the push-up brassiere.

These and other features of the articles of manufacture disclosed herein will become more apparent upon consideration of the following description and the appended claims with reference to the accompanying drawings, all of which form a part of this specification, wherein like reference numerals designate corresponding parts in the various figures. It is to be expressly understood, however, that the drawings are for purposes of illustration and description only and are not intended as a definition of the limits of the invention.

DETAILED DESCRIPTION

Embodiments of the disclosed technology relate to wire-free push-up brassieres having the versatility to provide enhanced lift, support, and comfort across a range of breast sizes. A wire-free push-up brassiere according to example embodiments of the disclosed technology includes a hinge that extends along a bottom edge of the padded portions of cups of the brassiere. The hinge may be a stabilizing channel formed between the bottom edge of the padded cup portions and a top edge of the cradle. In some embodiments, a width of the hinge channel may be defined by a vertical distance between a flexible cord that extends along a bottom edge of padded cup portions and a wire casing provided at a top portion of the cradle. The hinge may be formed of a stabilizing material that provides the hinge with both rigidity and flexibility. In particular, the stabilizing material may impart a rigidity to the hinge that reinforces the breast support provided by the cups, thereby enhancing the push-up characteristics of the brassiere. At the same time, the stabilizing material may have enough flexibility to allow the hinge to accommodate a range of breast sizes. In particular, the hinge may be flexible enough to transition between a folded state for smaller breast sizes and an expanded state in which the hinge serves as a expansion portion of the cups to provide enhanced support for larger breast sizes.

Figure 1A:
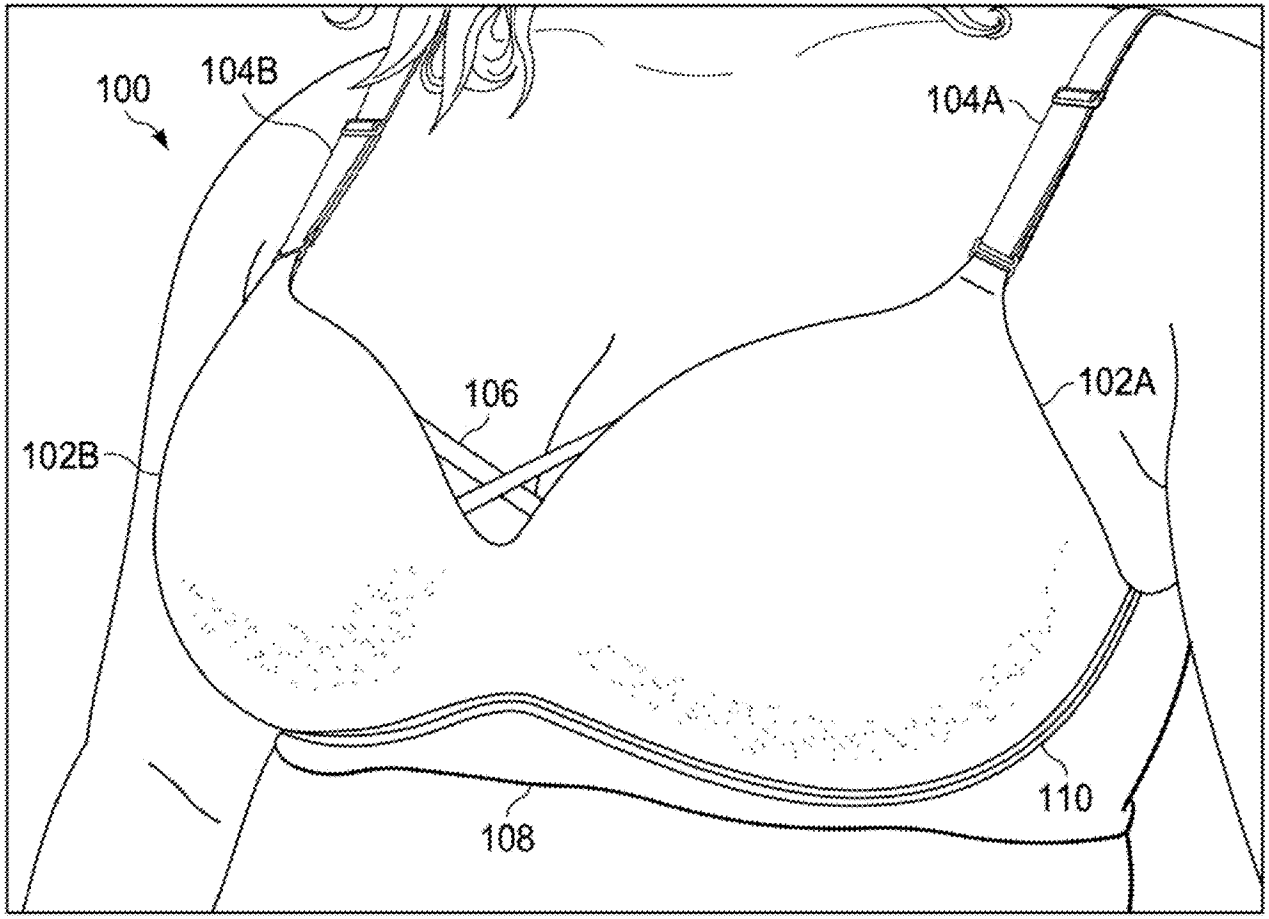
FIG. 1A shows a front perspective view of a wire-free push-up brassiere with hinge, in accordance with some embodiments of the disclosed technology.
Figure 1B:
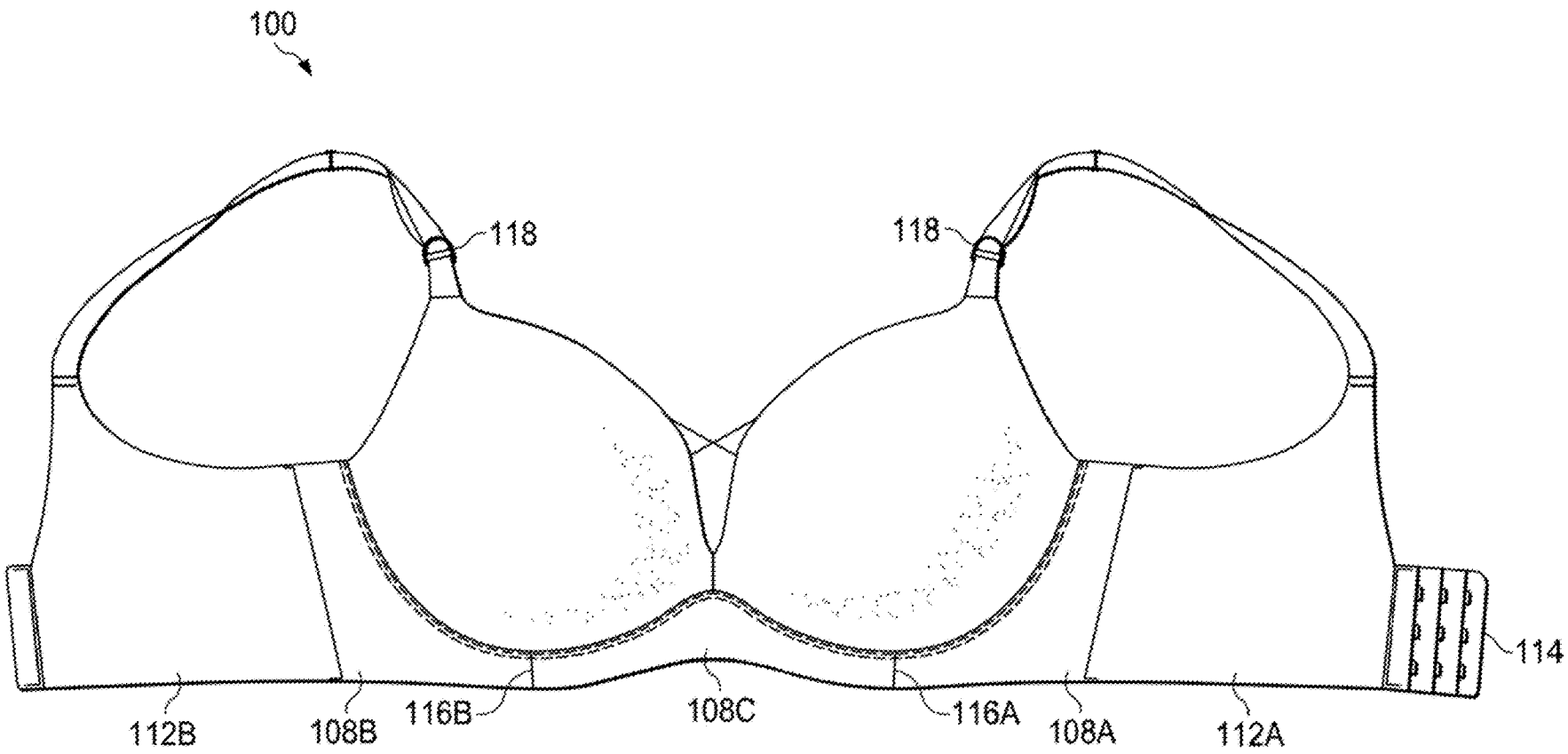
FIG. 1B shows a front portion and lateral wings of a wire-free push-up brassiere with hinge, in accordance with some embodiments of the disclosed technology.

FIG. 1A shows a front perspective view of a wire-free push-up brassiere 100 with hinge, in accordance with example embodiments of the disclosed technology. The wire-free push-up brassiere is shown being worn by a fuller-bodied woman in FIG. 1A. FIG. 1B shows a front portion and lateral wings of the wire-free push-up brassiere with hinge 100, in accordance with some embodiments of the disclosed technology. The brassiere 100 includes two cups—a left cup 102A and a right cup 102B connected medially by a bridge. The left cup 102A and the right cup 102B are connected to a cradle 108. In some embodiments, the left cup 102A, the right cup 102B, and the cradle 108 may be provided within an outer fabric casing.

As shown in FIG. 1B, the cradle includes a left cradle portion 108A, a central cradle portion 108C, and a right cradle portion 108B. In some embodiments, a layer of foam may be sandwiched between the outer fabric of the brassiere 100 at the central cradle portion 108C to provide comfort and stability to the bottom of the brassiere 100. In some embodiments, the cradle 108 may be a single integrally formed piece. In other embodiments, the left cradle portion 108A may be attached to the central cradle portion 108C via a dart 116A and the right cradle portion 108B may be attached to the central cradle portion 108C via a dart 116B. In some embodiments, one or both of the darts 116A, 116B may be bonded darts in which heat is used to fuse the wing and cradle portion together to join/close the dart opening. In other embodiments, one or both of the darts 116A, 116B may be sewn darts. Bonded darts may be flatter and less visible than sewn darts.

The brassiere 100 further includes a left wing 112A and a right wing 112B, each having respective first and second opposing lateral ends. The left wing 112A is connected to the left cradle portion 108A and the right wing 112B is connected to the right cradle portion 108C at their respective first ends. Each of the left wing 112A and the right wing 112B may wrap around a corresponding side of a wearer's torso, and may be attached to one another at a medial dorsal portion of the wearer's back via operation of a fastener 114. In this manner, the brassiere 100 may be removably secured to the wearer's body. The fastener may be, for example, a hook-and-eye type fastener that includes one or more hooks provided at the second end of the left wing 112A and one or more eyes provided at the second end of the right wing 112B. When each of the left wing 112A and the right wing 112B is wrapped around the wearer's torso, they may be attached to one another via insertion of the one or more hooks into the corresponding one or more eyes. It should be appreciated that, in other embodiments, the hook(s) may be provided at the second end of the right wing 112B and the eye(s) may be provided at the second end of the left wing 112A. In still other embodiments, different types of fasteners may be used to connect the wings 112A, 112B such as buttons, Velcro™, or the like.

The brassiere 100 further includes a left strap 104A and a right strap 104B. A first end of the left strap 104A connects to a top portion of the left cup 102A and a second opposing end of the left strap 104A connects to a top attachment portion of the left wing 112A. Similarly, a first end of the right strap 104B connects to a top portion of the right cup 102B and a second opposing end of the right strap connects to a top attachment portion of the right wing 112B. As shown in FIG. 1A, when the brassiere 100 is worn, the left strap 104A wraps over a left shoulder of the woman and the right strap 104B wraps over a right shoulder of the woman. As shown in FIG. 1B, the left and right straps 104A, 104B may include slides with teeth 118 that enable the wearer to adjust the lengths of the straps to accommodate different shoulder/torso lengths.

When the brassiere 100 is worn, the left and right straps 104A, 104B are wrapped around the wearer's left and right shoulders, respectively, the left and right wings 112A, 112B are wrapped around the left and right sides of the wearer's torso, respectively, and the fastener 114 is engaged. When the fastener 114 is connected, the wings 112A, 112B and the straps 104A, 104B expose a medial dorsal portion of the woman's back, including the woman's head, neck, upper portion of the woman's shoulders and upper portion of the woman's back. The medial dorsal portion of the wearer's back may be substantially framed by parts of the brassiere 100 that form the shape of the upper portion of an "H", a catenary shape, a modified catenary shape, or any other suitable shape, as disclosed in U.S. patent application Ser. No. 16/538,749.

In some embodiments, the brassiere 100 further includes a front corset 106. In some embodiments, the front corset 106 functions to maintain stability of the deep neckline. The material used for the front corset 106 may be a stretch elastic-type material that has sufficient give to provide comfort, while having at the same time, enough resilience to maintain to the brassiere's neckline shape.

In some embodiments, the brassiere 100 includes a wire casing 110. In some embodiments, the brassiere 100 is a wire-free push-up brassiere where no wire is contained in the wire casing 110. That is, in some embodiments, while the brassiere 100 may include the wire casing 110, no wire may be provided in the wire casing 110. Even in the absence of the wire, the cups 102A, 102B of the brassiere 100 provide a significant push-up function that is further enhanced by the operation of a hinge, as will be described in more detail later in this disclosure. It should be appreciated that the hinge is not directly viewable in the front views of FIGS. 1A and 1B.

In some embodiments, in order to increase comfort to the wearer, an outer fabric of the brassiere 100 may be formed from a microfiber material such as a brushed microfiber. In some embodiments, each of the left wing 112A and the right wing 112B may include a power mesh lining that is sandwiched between two layers of microfiber. In some embodiments, a zig-zag finish stitching may be applied to the first ends of the wings 112A, 112B (the portions that connect to the left and right cradle portions 108A, 108C, respectively), while a clean finish stitching may be applied to the opposing second ends of the wings 112A, 112B. It should be appreciated that the above examples of finish stitching and fabric materials are merely illustrative and not exhaustive.

Figure 2A:
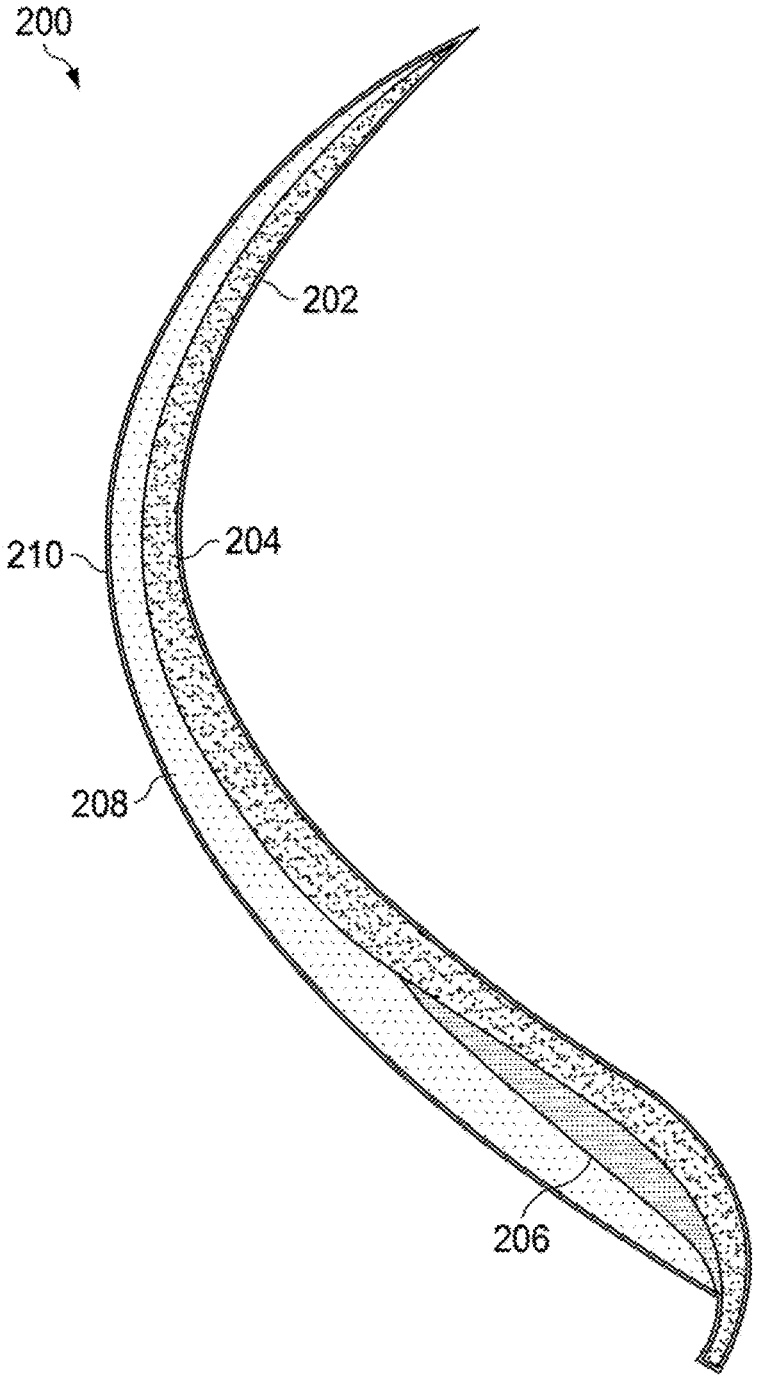
FIG. 2A shows a cross-section of a pad of a wire-free push-up brassiere with hinge, in accordance with some embodiments of the disclosed technology.

In example embodiments, each of the left cup 102A and the right cup 102B may include a three-dimensional (3D) pad covered in microfiber and finished, for example, with double-needle stitching under the cup at the connection to the cradle 108. An example configuration of the 3D pad 200 is shown in FIG. 2A. The pad 200 includes an inner fabric lining 202 and an outer fabric lining 210. While illustratively shown as being formed of a polyester material, the inner and outer fabric may be instead a microfiber material or any other suitable material. The pad 200 further includes a layer of marshmallow foam 204 and a layer of firm foam 208 that extend along a length of the pad 200. The firm foam layer 208 may be denser than the marshmallow foam layer 204 and more resistant to deformation. That is, the firm foam in layer 208 may take more time to return to its original shape after being deformed than the marshmallow foam in layer 204. In some embodiments, the marshmallow foam may be a plush foam that returns quickly to its original shape after deformation.

In some embodiments, a marshmallow foam cookie 206 may be provided within the layered pad 200. The marshmallow foam cookie 206 may be formed of the same or a similar marshmallow foam material as the marshmallow foam used to form the layer 204. In some embodiments, the marshmallow foam cookie 206 may not extend across an entire length of the pad 200. For instance, the marshmallow foam cookie 206 may be provided between only a portion of the marshmallow foam layer 204 and a portion of the firm foam layer 208. In particular, in the embodiment depicted in FIG. 2A, the marshmallow foam layer 204 and the firm foam layer 208 may be provided adjacent to one another within the pad 200 except for a segment in which the marshmallow foam cookie 206 is sandwiched between the layers 204, 208.

Figure 1C:
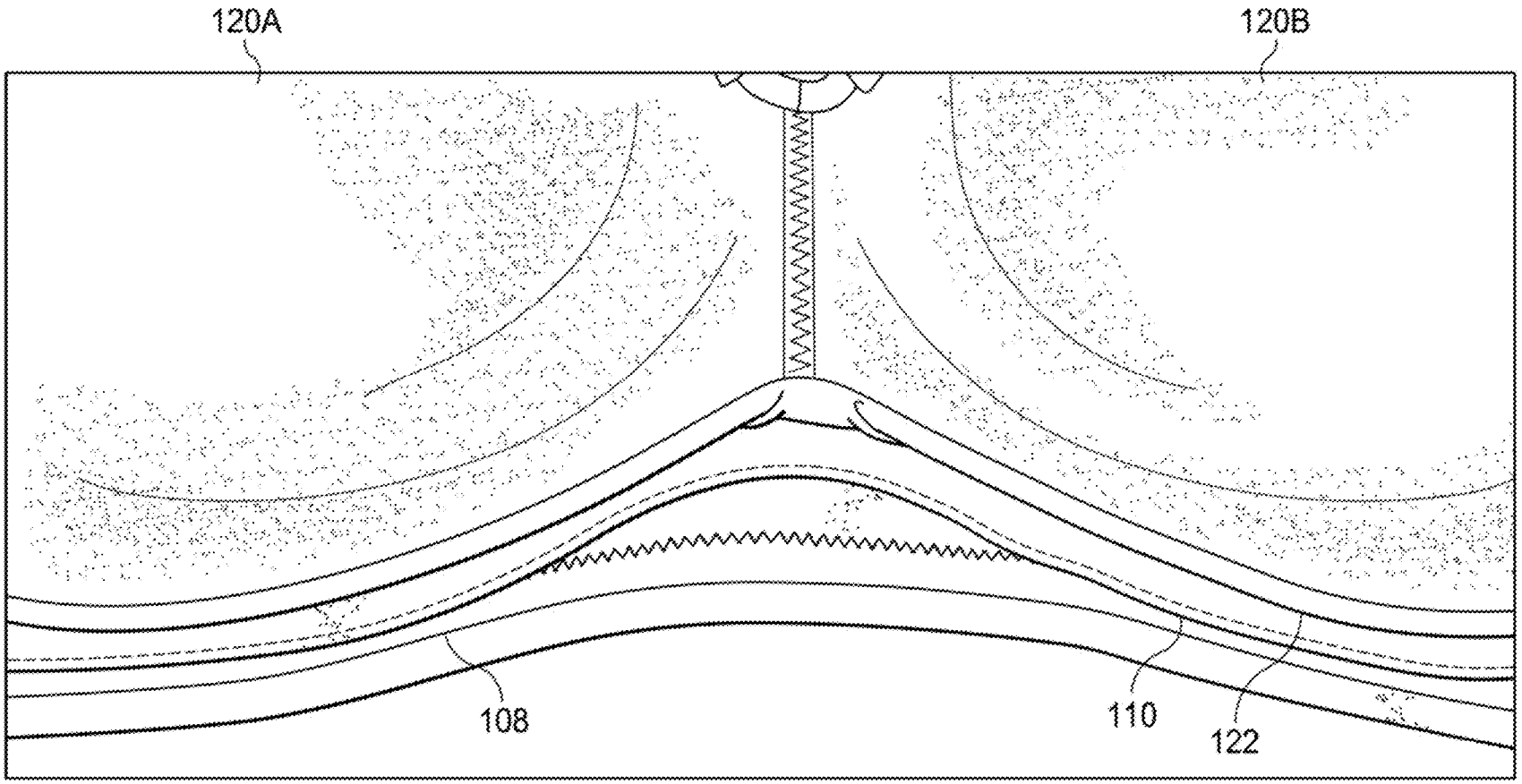
FIG. 1C shows a back view of a wire-free push-up brassiere with hinge, in accordance with some embodiments of the disclosed technology.

In example embodiments, the pad 200 may be provided within an outer fabric casing to form a padded cup portion of a cup (e.g., the left cup 102A, the right cup 102B). FIG. 1C shows a back view of the wire-free push-up brassiere 100 with hinge, in accordance with some embodiments of the disclosed technology. A padded cup portion 120A of the left cup 102A and a padded cup portion 120B of the right cup 102B are shown in FIG. 1C. Each of the left padded cup portion 120A and the right padded cup portion 120B may include a respective pad having the layered configuration of the pad 200 shown in FIG. 2A.

As will be described in more detail later in this disclosure, in some embodiments, the hinge may function as a cup expansion portion of a cup depending on the hinge's state. More specifically, the hinge may be configured to transition between a resting folded state when not worn or worn by women with relatively smaller breast sizes, to an expanded state when worn by women with relatively larger breast sizes. When the hinge is in the folded state, the hinge may not serve as a cup expansion portion of a cup, and the cup and the padded cup portion may be one and the same. In contrast, when the hinge is in the expanded state (or an intermediate state between a fully folded state and a fully expanded state), the hinge may serve as the cup expansion portion, and the cup may include both the padded cup portion as well as the hinge.

Also shown in FIG. 1C are the cradle 108 and the wire casing 110. In some embodiments, the wire casing 110 may extend along a top edge of the cradle 108. While only the central cradle portion 108C is shown in FIG. 1C, it should be appreciated that the wire casing 110 may extend along a top edge of the entire cradle including the left cradle portion 108A and the right cradle portion 108B as well. Also shown in FIG. 1C, is a flexible cord 122. The flexible cord 122 may be provided along a bottom edge of the left padded cup portion 120A and a bottom edge of the right padded cup portion 120B. In some embodiments, the flexible cord 122 may be fed into a casing that is provided at the bottom edges of the left and right padded cup portions 120A, 120B. The flexible cord 122 may be formed of a material that is both flexible and strong enough to assist in supporting the breasts when the brassiere 100 is worn and the cups 102A, 102B encapsulate the breasts. Further, while the cord 122 is flexible, it may have low elasticity, that is, it may not be easily stretchable.

Figure 1D:
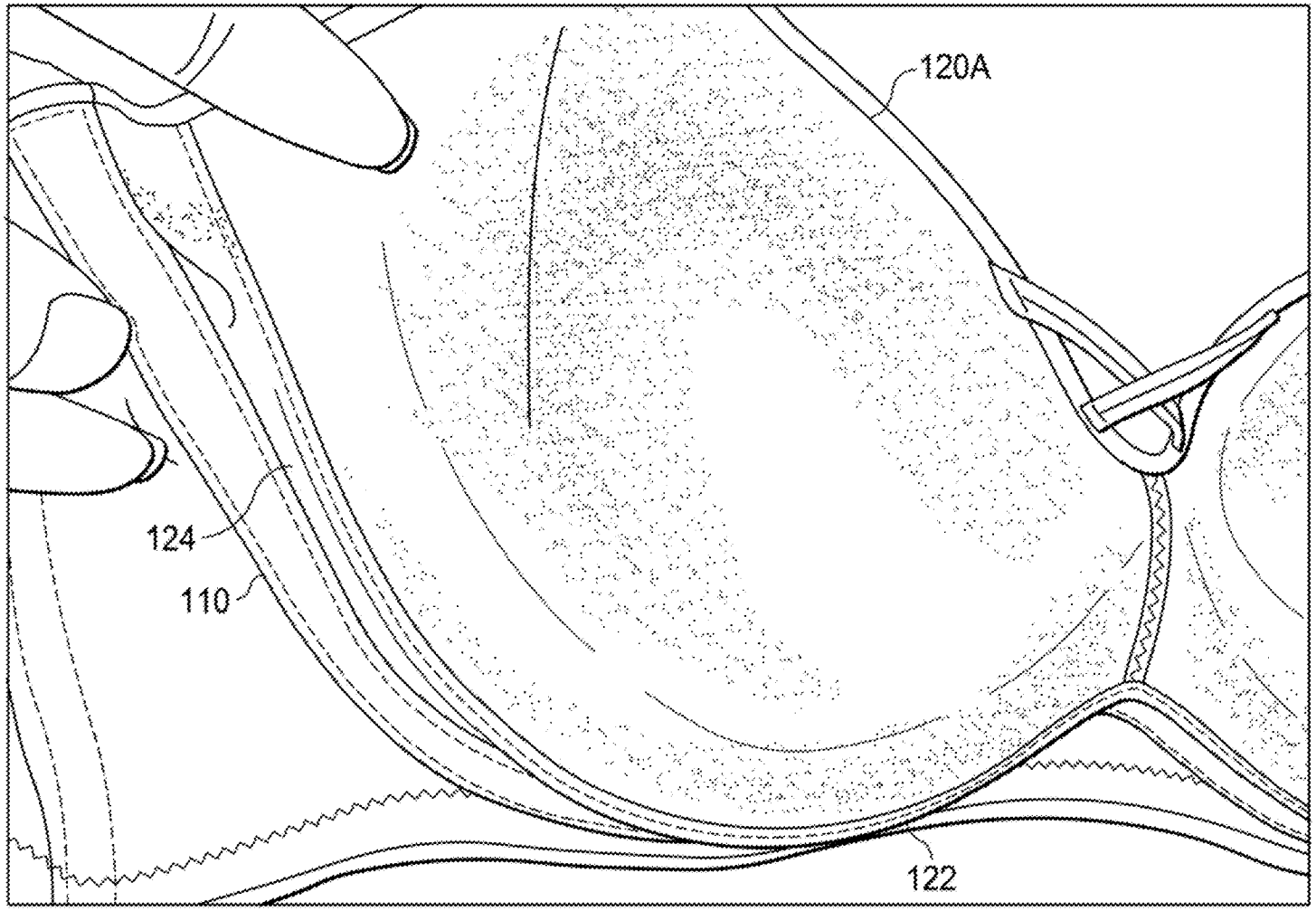
FIG. 1D shows a back perspective view of a wire-free push-up brassiere with the hinge in a folded state, in accordance with some embodiments of the disclosed technology.

As previously described, a wire-free push-up brassiere according to example embodiments of the disclosed technology includes a hinge that extends along a bottom edge of the cups of the brassiere and that provides flexible, enhanced support across a range of breast sizes. FIG. 1D depicts the hinge 124 for the example brassiere 100. The hinge 124 is shown in a folded state in FIG. 1D. The folded state may be a default state of the hinge 124 when the hinge is not worn as well as when the brassiere 100 is worn by women with a breast size below a certain threshold size. For instance, in some embodiments, the brassiere 100 may be designed for fuller-bodied women with breast sizes that are larger than the average breast size. As such, the hinge 124 may remain in the folded state even when worn by women with breast sizes that are larger (e.g., size D) than the average breast size across all women. However, in some embodiments, when the brassiere 100 is worn by women with even larger breast sizes (e.g., DD or DDD), the hinge 124 may expand from the folded state to an expanded state, in which the hinge 124 functions as an expanded portion of the cups 102A, 102B (i.e., a cup expansion portion) that further enhances the breast support provided by the padded cup portions 120A, 120B.

The hinge 124 is depicted in the folded state in FIG. 1D. While the hinge 124 is stretched slightly towards a top of the left padded cup portion 120A to expose the hinge 124 in FIG. 1D so that it can be better visualized, it should be appreciated that in the folded state of FIG. 1D, the hinge 124 is substantially or fully hidden behind the cups 102A, 102B, or more specifically, behind the padded cup portions 120A, 120B. More specifically, in the folded state, the hinge 124 may be completely or substantially hidden by the elastic outer fabric covers the padded cup portions 120A, 120B. In contrast, the hinge 124 is shown in an expanded state in FIG. 1E.

Figure 1E:
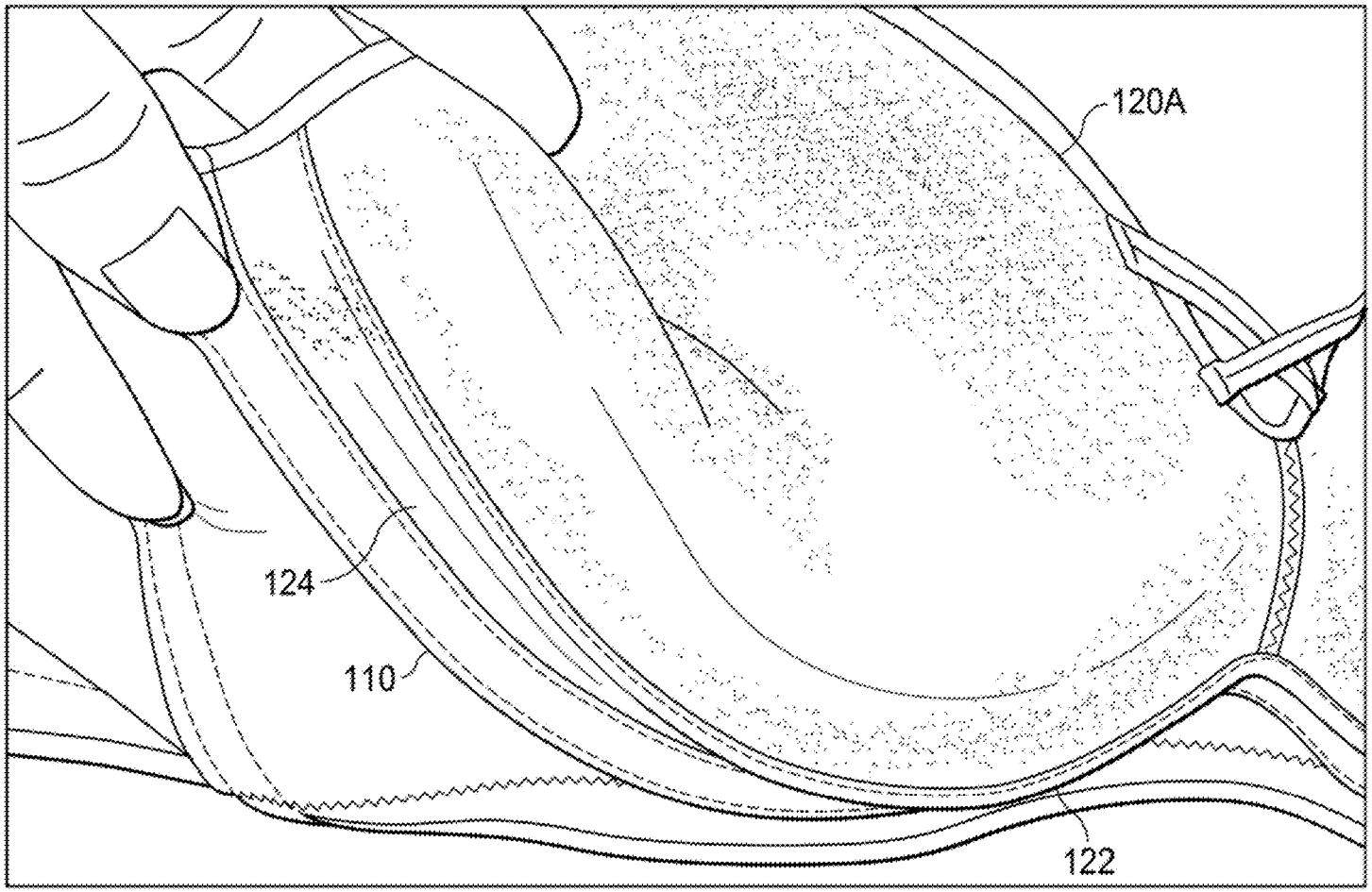
FIG. 1E shows a back perspective view of a wire-free push-up brassiere with the hinge in an expanded state, in accordance with some embodiments of the disclosed technology.

While only the left padded cup portion 120A is shown in FIG. 1E, it should be appreciated that, in example embodiments, the hinge 124 extends along bottom edges of the left and the right padded cup portions 120A, 120B of the left and right cups 102A, 102B of the brassiere 100. More specifically, the hinge 120 may be formed as a channel that sits between the flexible cord 122 that runs along the bottom edges of the left and right padded cup portions 120A, 120B and a top edge of the cradle 108. In particular, the hinge 124 may be provided within an undercup channel that runs laterally across the brassiere 100 between the flexible cord 122 and a top edge of the wire casing 110. In some embodiments, the wire casing 110 may be treated as part of the cradle 108, while in other embodiments, the wire casing 110 may be considered to be distinct from the cradle 108.

In some embodiments, the hinge 124 may be formed of a rigid stabilizing fabric that enables movement of the breasts encapsulated by the padded cup portions 120A, 120B independently of the wearer's chest/rib cage area where the cradle 108 sits against the wearer's body. That is, the hinge 124 may be formed from a material that is more rigid and less easily stretchable than the outer fabric material that encapsulates the padded cup portions 120A, 120B. In this manner, the hinge 124 enables a flexible and versatile fit across a range of breast sizes, while still ensuring a snug fit against the wearer's body. More specifically, the hinge 124 is flexible enough to accommodate a range of breast sizes for a padded cup portion of a given size, but rigid enough to ensure that the cradle 108 sits snugly against the wearer's mid-section. The rigidity of the hinge 124 ensures that it fixes against the wearer's chest wall, while still allowing the breasts to be encapsulated by the padded cup portions 120A, 120B. In this manner, the hinge 124 enhances both the comfort and the support of the brassiere 100.

As previously described, the hinge 124 may constitute part of the cups 102A, 102B (i.e., expanded portions of the cups) or may not form part of the cups 102A, 102B depending on the state of the hinge 124. More specifically, when the hinge 124 is in the folded state—corresponding to a state in which the brassiere 100 is not worn or is being worn by a wearer having a breast size that is towards the smaller end of the spectrum of breast sizes that the brassiere 100 is designed for—the hinge 124 may not serve as an expansion portion of the cups 102A, 102B. Thus, when the hinge 124 is in the folded state, a cup of the brassiere 100 may be defined by the padded cup portion, and not by the hinge as well.

That is, when the hinge 124 is in the folded state, a bottom edge of a padded cup portion (e.g., left padded cup portion 120A) may correspond to the bottom edge of the cup (e.g., the left cup 102A). In some embodiments, the bottom edge of a padded cup portion may be defined by the flexible cord 122. This is shown in the front view of FIG. 1F, in which the hinge 124 is in the folded state, and thus, does not function as a cup expansion portion of the left cup 126, for example.

Figure 1G:
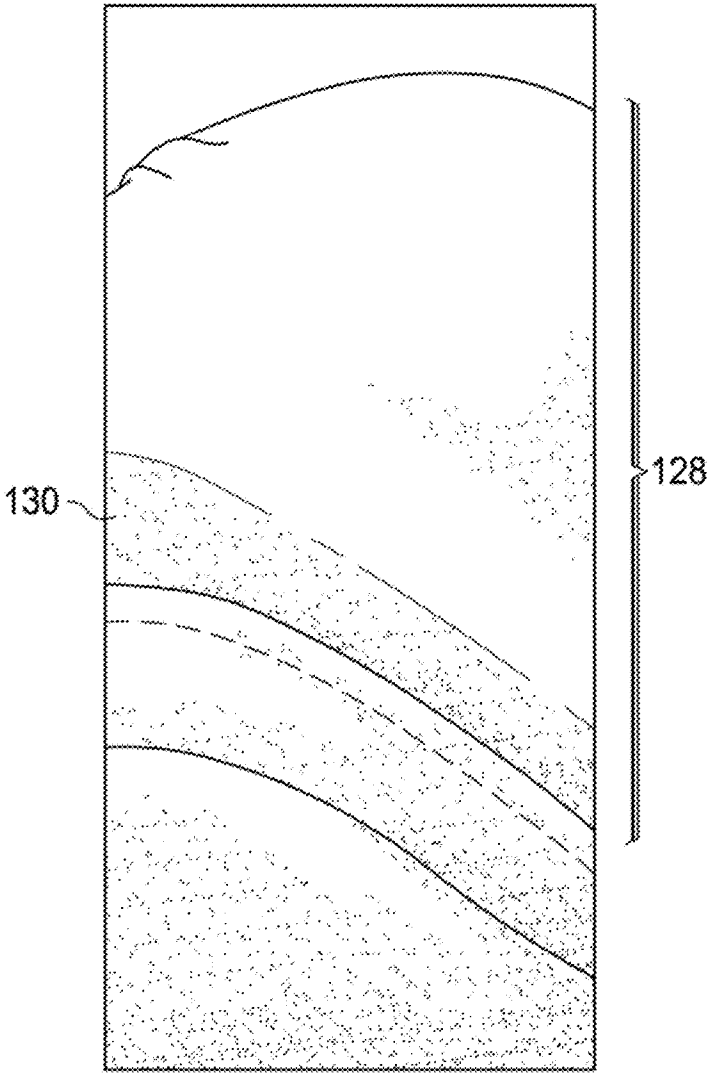
FIG. 1G shows a front view of a wire-free push-up brassiere with the hinge in the expanded state and operating as a cup expansion portion, in accordance with some embodiments of the disclosed technology.
Figure 1F:
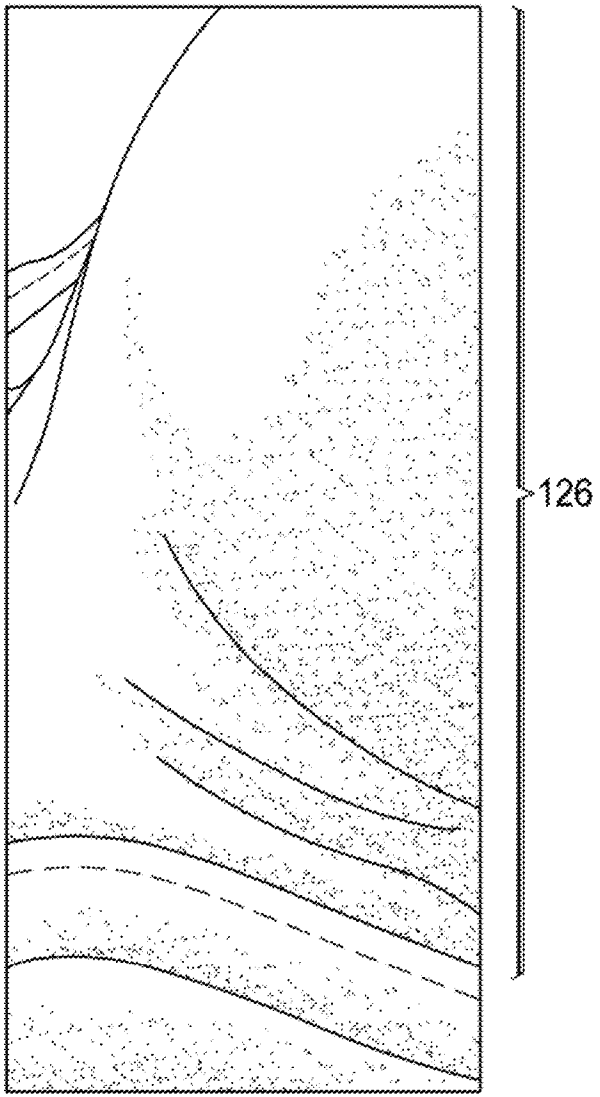
FIG. 1F shows a front view of a wire-free push-up brassiere with the hinge in the folded state and not operating as a cup expansion portion, in accordance with some embodiments of the disclosed technology.

In contrast, when the hinge 124 is in an expanded state, the hinge 124 may function as a cup expansion portion such that each of the cups 102A, 102B include their respective padded cup portions 120A, 120B as well as the hinge 124. That is, when the hinge 124 is in an expanded state, the hinge 124—now functioning as a cup expansion portion 130—may define a bottom portion of the cups 102A, 102B. FIG. 1G illustratively shows the left cup 128 with the hinge 124 functioning as a cup expansion portion. It should be appreciated that pressure is being applied to the hinge 124 to make it visible in FIG. 1G, and that the hinge 124—even when in an expanded state—may not be visible from the front of the brassiere 100.

In some embodiments, the hinge 124 may be configured to transition between a range of states, from a fully folded state at one end of the spectrum, to a fully expanded state at the other end of the spectrum. In some embodiments, the hinge 124 may remain in the fully folded state for any breast size that is below a first threshold breast size. For breast sizes that exceed this first threshold breast size, the hinge 124 may begin to expand, transitioning from the fully folded state to increasing levels of partial expansion as the size of the breasts increases, until the hinge 124 reaches a fully expanded state for breast sizes that are a second threshold breast size or greater. In some embodiments, the hinge 124 may function as a cup expansion portion even when in a partially expanded state. In other embodiments, the hinge 124 may only function as a cup expansion portion when the hinge 124 is in the fully expanded state.

Figure 1H:
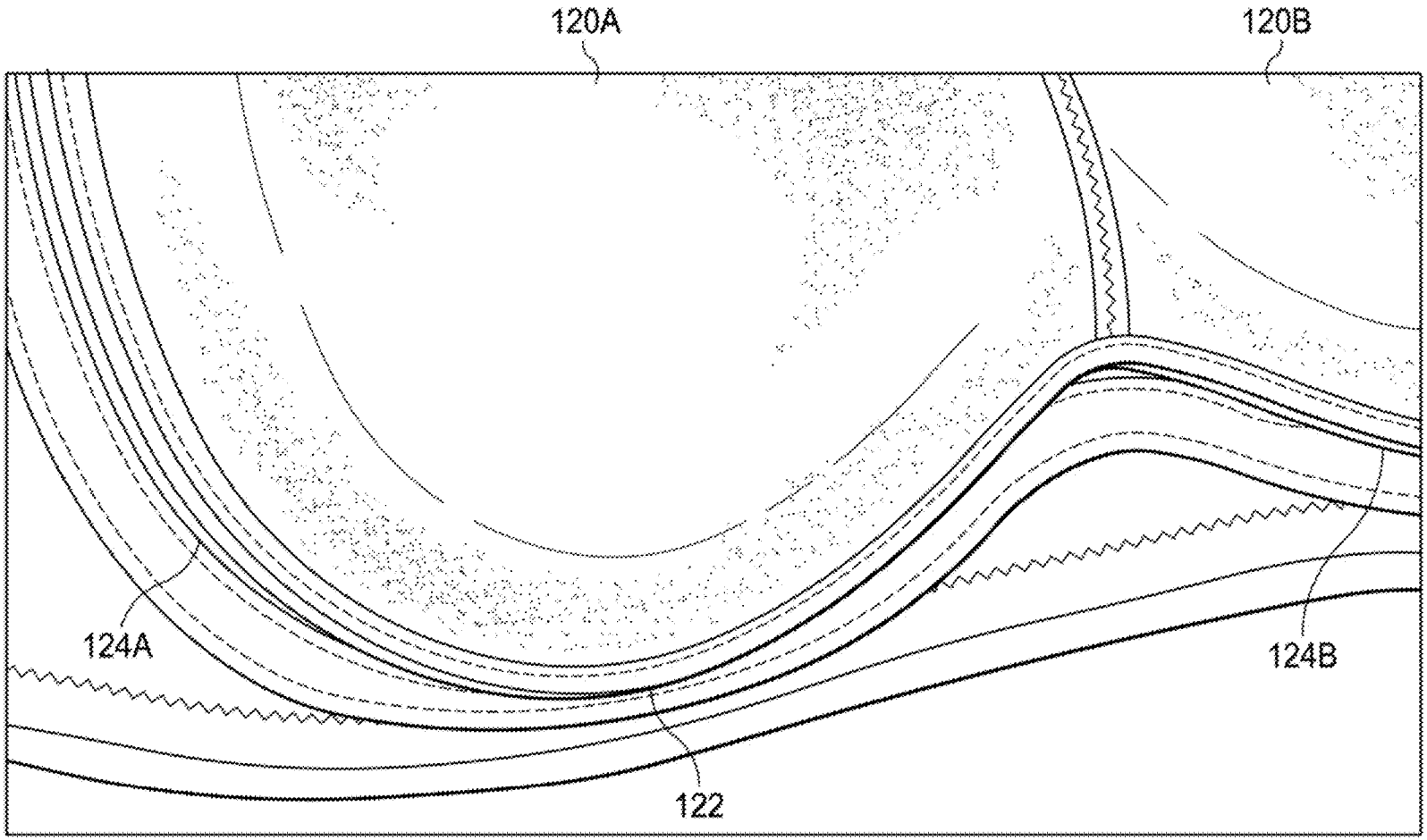
FIG. 1H shows a back perspective back of a wire-free push-up brassiere with hinge, in accordance with some embodiments of the disclosed technology.

As shown in FIG. 1H, the hinge 124 may include a left hinge portion 124A formed as an undercup channel between a bottom edge of the left padded cup portion 120A and a portion of a top edge of the cradle 108. More specifically, the left hinge portion 124A may be formed as an undercup channel that extends along a bottom edge of the left padded cup portion 120A, a concave edge of the left cradle portion 108A, and a left portion of a top edge of the central cradle portion 108C. The hinge 124 may further include a right hinge portion 124B formed as an undercup channel between a bottom edge of the right padded cup portion 120B and a portion of a top edge of the cradle 108. More specifically, the right hinge portion 124B may be formed as an undercup channel that extends along a bottom edge of the right padded cup portion 120B, a concave edge of the right cradle portion 108B, and a right portion of a top edge of the central cradle portion 108C.

In some embodiments, the hinge 124 may travel the entire length of the undercup channel. That is, the left hinge portion 124A and the right hinge portion 124B may together travel the entire length of the undercup channel. In some embodiments, the left hinge portion 124A and the right hinge portion 124B may be formed as a single continuous piece. In other embodiments, the left hinge portion 124A may be separately formed from the right hinge portion 124B. In some embodiments, the left hinge portion 124A and the right hinge portion 124B may be formed of different stabilizing materials having different levels of rigidity.

As previously described, the hinge 124 may be formed of one or more stabilizing materials that provide the hinge with both rigidity and flexibility. In particular, the stabilizing material may impart a rigidity to the hinge 124 that serves to both reinforce the breast support provided by the cups 102A, 102B, thereby enhancing the push-up characteristics of the brassiere 100, as well as ensuring a snug fit of the cradle 108 against the wearer's torso. At the same time, the stabilizing material may have enough flexibility to allow the hinge 124 to transition between a folded state and various expanded states so as to accommodate a range of breast sizes.

Figure 2B:
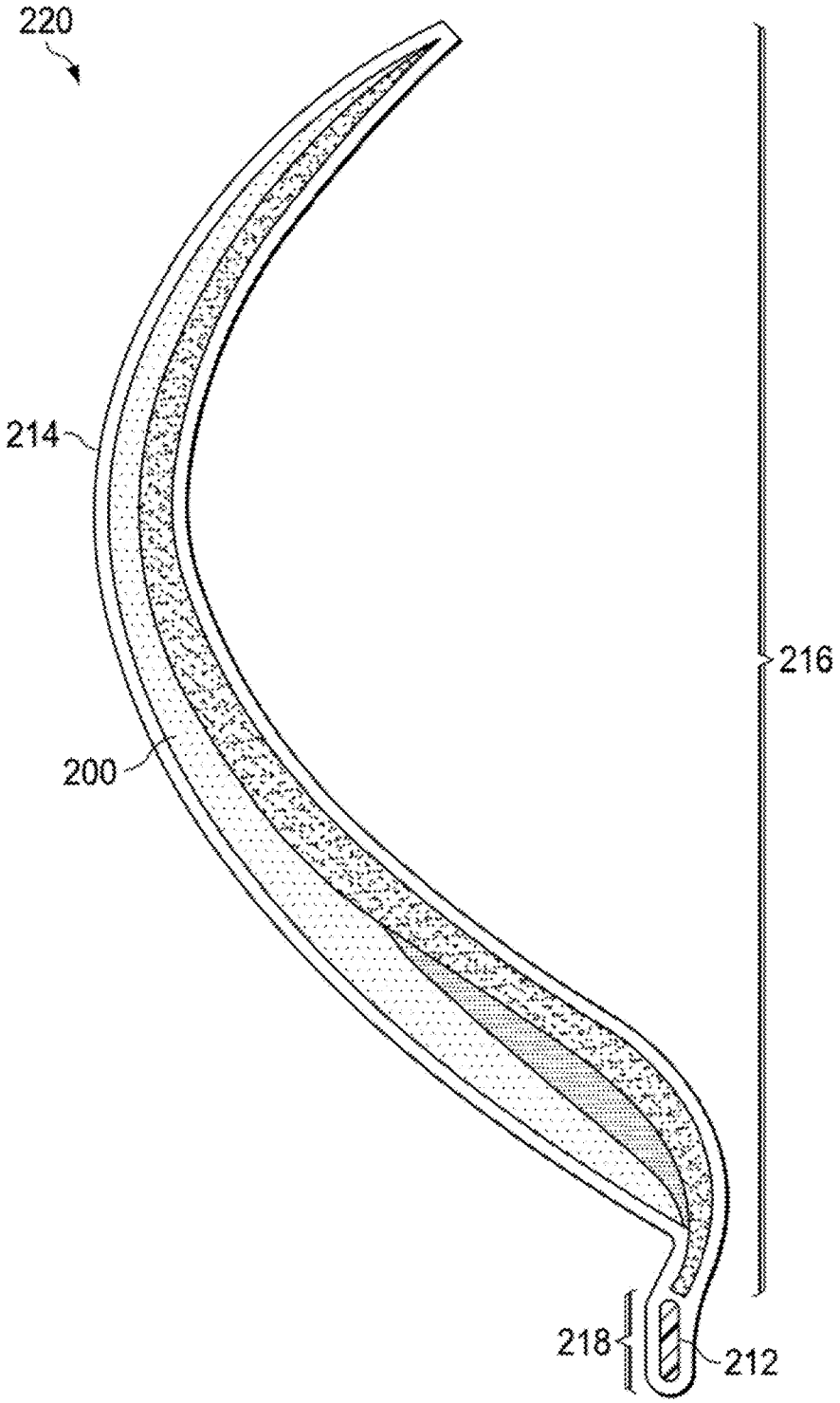
FIG. 2B shows a cross-section of a cup of a wire-free push-up brassiere with hinge, in accordance with some embodiments of the disclosed technology.

FIG. 2B depicts a cross-section of a cup 220 of a brassiere according to example embodiments of the disclosed technology. The cup 220 may be a particular configuration of the left cup 102A and/or the right cup 102B. The cup 220 may include, for example, a pad 200 having the example cross-section shown in FIG. 2A. The cup 220 may be encapsulated by an outer fabric casing 214, which may be a microfiber material, for example. The pad 200 covered in the outer fabric casing 214 may constitute a padded cup portion 216, such as left padded cup portion 120A or right padded cup portion 120B. A hinge 212 is also depicted in FIG. 2B. The hinge 212 may be a particular implementation of the hinge 124. In some embodiments, the hinge 212 may function as a cup expansion portion 218 of the cup 220. In other embodiments, such as those in which the hinge 212 is in a partial or fully expanded state, the hinge 212 may not serve as a cup expansion portion, and thus, may not form part of the cup 220.

Throughout this specification, plural instances may implement components, operations, or structures described as a single instance. Although individual operations of one or more methods are illustrated and described as separate operations, one or more of the individual operations may be performed concurrently, and nothing requires that the operations be performed in the order illustrated. Structures and functionality presented as separate components in example configurations may be implemented as a combined structure or integral component. Similarly, structures and functionality presented as a single component may be implemented as separate components. These and other variations, modifications, additions, and improvements fall within the scope of the subject matter herein.

Those skilled in the art will recognize that various modifications may be made, and other embodiments may be used without departing from the broader scope of the present invention(s). Therefore, these and other variations upon the example embodiments are intended to be covered.

The invention claimed is:

1. A brassiere, comprising:

a left cup comprising a left cup portion;

a right cup comprising a right cup portion;

a bridge medially connecting the left cup portion and the right cup portion;

a cradle extending horizontally across at least a first portion of the left cup, the bridge and a first portion of the right cup; and a hinge extending horizontally across at least a second portion of the left cup, the bridge and a second portion of the right cup, and being disposed below the left cup portion, the bridge and the right cup portion and above the cradle, the hinge being configured to be in a folded state or in one or more at least partially unfolded states based on a breast size of a wearer of the brassiere.

2. The brassiere of claim 1, further comprising:

a wire casing extending horizontally across at least a third portion of the left cup, the bridge and a third portion of the right cup, and being disposed below the hinge and above the cradle.

3. The brassiere of claim 1, wherein the brassiere is configured such that respective bottom edges of the left cup portion and the right cup portion define respective bottom edges of the left cup and the right cup when the hinge is in the folded state.

4. The brassiere of claim 1, further comprising:

an outer fabric casing encapsulating at least the left cup and the right cup.

5. The brassiere of claim 1, wherein the hinge is configured to be hidden from view when the hinge is in the folded state.

6. The brassiere of claim 1, wherein the hinge is configured to be in the folded state when the breast size of the wearer is less than or equal to a first threshold breast size.

7. The brassiere of claim 1, wherein the one or more at least partially unfolded states comprise one or more partially unfolded states and a fully unfolded state.

8. The brassiere of claim 7, wherein the hinge is configured to be in one of the one or more partially unfolded states when the breast size of the wearer is greater than the first threshold breast size and less than or equal to a second threshold breast size.

9. The brassiere of claim 8, wherein the hinge is configured to be in the fully unfolded state when the breast size of the wearer is greater than the second threshold breast size.

10. The brassiere of claim 1, wherein the hinge comprises a stabilizer material having greater rigidity than an outer fabric casing of the brassiere.

* * * * *